US011471897B2

(12) United States Patent
Kühnert

(10) Patent No.: US 11,471,897 B2
(45) Date of Patent: Oct. 18, 2022

(54) CENTRIFUGE ROTOR HAVING SEAL

(71) Applicant: Eppendorf AG, Hamburg (DE)

(72) Inventor: Steffen Kühnert, Leipzig (DE)

(73) Assignee: Eppendorf AG, Hamburg (DE)

( * ) Notice: Subject to any disclaimer, the term of this patent is extended or adjusted under 35 U.S.C. 154(b) by 547 days.

(21) Appl. No.: 16/625,634

(22) PCT Filed: Jun. 19, 2018

(86) PCT No.: PCT/EP2018/066307
§ 371 (c)(1),
(2) Date: Dec. 20, 2019

(87) PCT Pub. No.: WO2018/234334
PCT Pub. Date: Dec. 27, 2018

(65) Prior Publication Data

US 2021/0187518 A1 Jun. 24, 2021

(30) Foreign Application Priority Data

Jun. 21, 2017 (EP) ..... 17177239

(51) Int. Cl.
*B04B 7/08* (2006.01)
*B04B 5/04* (2006.01)
*B04B 7/02* (2006.01)

(52) U.S. Cl.
CPC ..... *B04B 7/08* (2013.01); *B04B 5/0414* (2013.01); *B04B 2007/025* (2013.01)

(58) Field of Classification Search
CPC ..... B04B 7/08; B04B 5/0407; B04B 5/0414; B04B 2007/025
See application file for complete search history.

(56) References Cited

U.S. PATENT DOCUMENTS 4,054,243 A 10/1977 Volkov et al.
4,710,160 A * 12/1987 Klintenstedt ..... B04B 7/08 494/64
6,286,838 B1 9/2001 Krüger et al.
2006/0240963 A1 10/2006 Henne
2007/0128080 A1 6/2007 Lohn
2013/0316889 A1 11/2013 Asakura et al.
(Continued)

FOREIGN PATENT DOCUMENTS

CN 1840237 A 10/2006
CN 1974016 A 6/2007
CN 201158498 12/2008
(Continued)

OTHER PUBLICATIONS

National Intellectual Property Administration of the People's Republic of China, Office Action in related application CN Application No. 2018800491226.

*Primary Examiner* — Timothy C Cleveland
(74) *Attorney, Agent, or Firm* — Smartpat PLC

(57) ABSTRACT

A centrifuge rotor for sample vessels includes a seal between a lower part and a cover. The seal comprises a gasket, which is arranged in a first groove. The first groove is arranged on one of the elements constituted by the cover and the lower part. The first groove, in relation to the axis of rotation of the centrifuge rotor, is open axially toward the other of the elements constituted by the cover and the lower part.

16 Claims, 6 Drawing Sheets

(56) References Cited

U.S. PATENT DOCUMENTS

2017/0252754 A1 9/2017 Hoelderle et al.

FOREIGN PATENT DOCUMENTS

| | | | |
|---|---|---|---|
| CN | 202267307 | U | 6/2012 |
| CN | 103447164 | A | 12/2013 |
| CN | 204933739 | U | 1/2016 |
| CN | 205094236 | U | 3/2016 |
| CN | 106856657 | A | 6/2017 |
| DE | 102014112501 | A1 | 3/2016 |
| GB | 2233584 | A | 1/1991 |
| JP | 6136509 | B2 | 5/2017 |

* cited by examiner

CENTRIFUGE ROTOR HAVING SEAL

TECHNICAL FIELD

The present disclosure relates to a centrifuge rotor having a sealed interior space.

BACKGROUND

Centrifuge rotors are used in centrifuges, in particular laboratory centrifuges, to separate the components of samples centrifuged therein by exploiting mass inertia. In doing so, increasingly higher rotational speeds are used to achieve high segregation rates. Laboratory centrifuges are centrifuges whose rotors preferably operate at at least 3,000, preferably at least 10,000, in particular at least 15,000 revolutions per minute and are usually placed on tables. In order to be able to place them on a worktable, they have in particular a form factor of less than 1 m×1 m×1 m, so their installation space is limited. Preferably, the device depth is limited to a max. of 70 cm.

In most cases, the samples are centrifuged at certain temperatures. For example, samples containing proteins and similar organic substances must not be overheated, such that the upper limit for the temperature control of such samples is in the range of +40° C. as standard. On the other hand, certain samples are cooled in the standard range of +4° C. (the anomaly of the water starts at +3.98° C.).

In addition to such predetermined maximum temperatures of approximately +40° C. and standard test temperatures such as +4° C., other standard test temperatures are also provided, such as +11° C., in order to check at such temperature whether the refrigeration system of the centrifuge runs below room temperature in a controlled manner. On the other hand, for reasons of occupational safety, it is necessary to avoid touching elements that have a temperature greater than or equal to +60° C.

In principle, active and passive systems can be used for temperature control. Active cooling systems have a refrigerant circuit that regulates the temperature of the centrifuge vessel, which indirectly cools the centrifuge rotor and the sample containers it holds.

Passive systems are based on cooling or ventilation assisted by exhaust air. Such air is led directly past the centrifuge rotor, which ensures temperature control. The air is sucked into the centrifuge vessel through openings, wherein the air is sucked in automatically through the rotation of the centrifuge rotor.

The samples to be centrifuged are stored in sample containers and such sample containers are rotated by means of a centrifuge rotor. There are different centrifuge rotors that are used depending on the application. Thereby, the sample containers can contain the samples directly, or the sample containers can have their own sample receptacles containing the sample, such that a large number of samples can be centrifuged simultaneously in one sample container.

In general, such centrifuge rotors have a lower part and a cover, wherein, in the closed state of the cover, an interior space is formed between the lower part and the cover, in which interior space the sample vessels can be arranged, in order to centrifuge the samples in a suitable centrifuge. If the sample vessels are arranged at a fixed angle in the centrifuge rotor, this is a so-called "fixed-angle rotor."

For connecting to the centrifuge, the lower part is usually equipped with a hub that can be coupled to the motor-driven drive shaft of the centrifuge. Usually, the cover in turn can be screwed to the lower part.

A fluid-tight seal is usually provided between the cover and the lower part, wherein, for example, the FA-45-48-11 fixed-angle rotor from Eppendorf®, which can be used, for example, in the 5430 R laboratory centrifuge from Eppendorf®, has a discus-like cover, in which a radially outwardly open groove is arranged, wherein the groove contains an O-ring as a gasket. When closing, the cover is inserted into a corresponding approximately vertical recess in the lower part and is clamped downwards, wherein the O-ring is clamped between the groove and the side wall of the lower part in order to create the seal.

The problem with this solution is that the seal, in particular if it is dry, warps upon closing due to friction when sliding along the bottom part. On the one hand, this can make the opening process highly difficult. In addition, the sealing ring may even crack or be destroyed during centrifugation.

In addition, warping can cause even the smallest leaks. On the other hand, there are generally certain tolerances between the lower part and the cover, but also at the locking mechanisms, which is why the sealing ring may be ejected upon centrifugation.

SUMMARY

It is therefore the object of this invention to improve the seal between the lower part and the cover of a centrifuge rotor. In particular, the seal should be more effective and more durable. In addition, the opening and closing process should preferably be facilitated.

This object is accomplished by the centrifuge rotor as claimed.

The inventor recognized that this task could be solved in a surprisingly simple manner by arranging the groove for holding the gasket in such a manner that it is axially aligned; that is, it is opened axially from one of the two elements of cover and lower part to the other of the two elements of cover and lower part. Then, the gasket can no longer warp or not as strongly warp during opening and closing. In addition, centrifugation prevents the gasket from being ejected from the groove.

Thus, the centrifuge rotor has a lower part and a cover. Sample vessels can be arranged in the centrifuge rotor. The sample vessels are secured against removal in the closed state of the centrifuge rotor. In the closed state of the centrifuge rotor, an interior space is formed between the lower part and the cover. Between the lower part and the cover, there is a seal that seals the interior space in a fluid-tight manner with respect to the surroundings of the centrifuge rotor. The seal has a gasket that is arranged in a first groove. The first groove is arranged on one of the elements of cover and lower part, and characterized in that the first groove is formed to be axially open with respect to the axis of rotation of the centrifuge rotor towards the other of the elements of cover and lower part.

In an advantageous additional form, it is provided that the gasket has a radially extending base and an axially extending leg arranged thereon. The axial leg provides a particularly effective seal, for which only very low contact pressures are sufficient.

In an advantageous additional form, it is provided that the leg becomes thicker towards the base and is preferably formed to be conical on at least one side, wherein the conicity preferably lies in the range 2°-10°, preferably 4°-8° and in particular amounts to 6°. This ensures that the seal is particularly uniform, even with tolerances.

In an advantageous additional form, it is provided that the other of the elements of cover and lower part in the closed state at least rests on the leg. This makes the seal particularly effective.

In an advantageous additional form, it is provided that the other of the elements of cover and lower part has a first section extending axially towards one of the elements of cover and lower part, which in the closed state extends into the first groove. This enables very high contact pressures to be achieved and maintained securely. In addition, the groove overlaps the first section, making the seal highly secure and protected.

In an advantageous additional form, it is provided that the lower part below the gasket has a section that runs radially outwards, in particular in an inclined manner, in the direction away from the cover. Any fluids that may arise are thus diverted away from the seal. Preferably, this section running in an inclined manner is connected to the first section if it is arranged on the lower part.

Within the framework of this invention, the term "fluids" refers to both gases and liquids.

In an advantageous additional form, it is provided that the lower part below the gasket has a channel that is preferably arranged radially further out than the gasket. This ensures that any fluids that may arise are securely collected in the channel.

In an advantageous additional form, it is provided that the other of the elements of cover and lower part has a second groove that opens axially towards one of the elements of cover and lower part and that interacts with the first groove in the closed state. This results in a particularly secure seal. In addition, the seal is also centered and the placement of the cover on the lower part is facilitated.

In an advantageous additional form, it is provided that the first section radially delimits the second groove to the inside. This results in a particularly secure seal, because a meandering engagement between the two grooves arises, wherein any fluid that may arise is rejected in the operating state of the seal.

In an advantageous additional form, it is provided that the first groove has a radially inner first boundary and a radially outer second boundary, which are preferably formed as projections. The cover is then particularly lightweight, which simplifies the centrifugation.

In an advantageous additional form, it is provided that the first boundary extends in the direction of the lower part in a manner axially deeper than the second boundary. The seal is then formed to be particularly effective and protected.

In an advantageous additional form, it is provided that the first section of the lower part in the closed state is covered by the first boundary. The seal is then formed to be particularly effective and protected.

In an advantageous additional form, it is provided that the centrifuge rotor is a bowl-shaped centrifuge rotor, which is formed in particular as a fixed-angle rotor.

Preferably, the first groove is on the cover and open axially towards the lower part. Then, the first section is arranged on the lower part and preferably delimits a second groove, which interacts with the first groove.

However, a reverse formation can also be provided, such that the first groove is on the lower part and formed to be open axially towards the cover. Then, the first section is arranged on the cover and preferably delimits a second groove, which interacts with the first groove.

The features and other advantages of this invention will be illustrated in the following on the basis of the description of preferred exemplary embodiments in connection with the figures.

DETAILED DESCRIPTION

Figure 1:
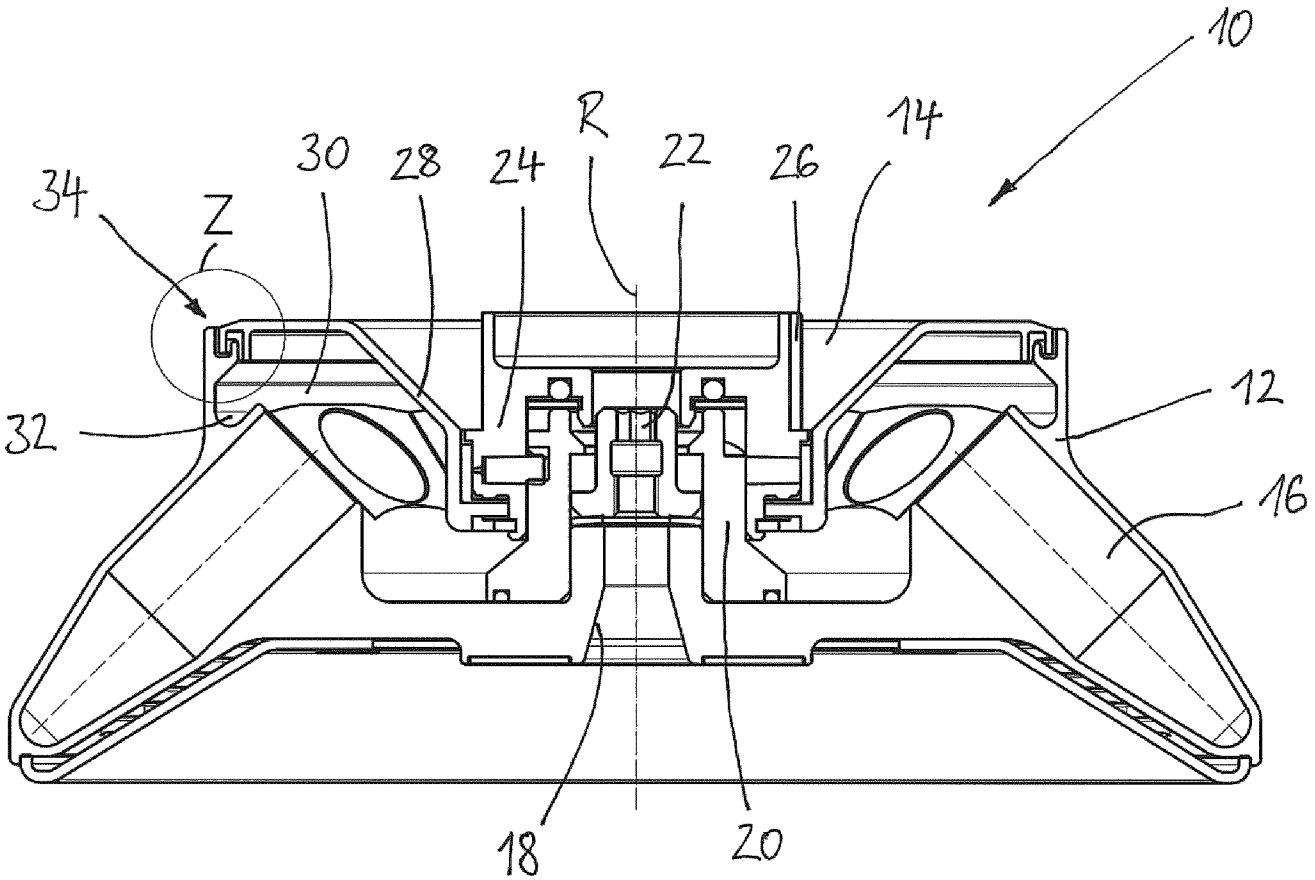
FIG. 1 shows a centrifuge rotor in accordance with a first preferred configuration in a lateral sectional view.

FIG. 1 shows that the centrifuge rotor 10 has a lower part 12 and a cover 14. In principle, the centrifuge rotor 10 is made of a metal, preferably a metal containing aluminum.

In the lower part 12, there are bores 16 for receiving sample vessels (not shown). In addition, the lower part 12 has a shaft support 18 for receiving a drive shaft of a suitable laboratory centrifuge 100 (for example, the 5430 R laboratory centrifuge from Eppendorf®, not shown) (see FIG. 4).

In addition, the lower part 12 has first locking means 20 known to the specialist, for example, from the FA-45-48-11 fixed-angle rotor from Eppendorf®, which also include a rotor nut 22 with which the centrifuge rotor 10 is fastened to the drive shaft.

The cover 14 in turn has second locking means 24 known to the specialist, for example, from the FA-45-48-11 fixed-angle rotor from Eppendorf®, with an actuating element 26, with which a user (not shown) can place the cover 14 on the lower part 12 and lock the second 24 with the first locking means 20. In addition, the actuating element can be used to turn the rotor nut 22 on the lower part 12 even in the closed state of the cover 14, by which the centrifuge rotor 10 can be attached to the drive shaft or detached from it even in the closed state, thus inserting it into the centrifuge or removing it from the centrifuge.

The second locking element 24 with the actuating element 26 is connected to the actual cover body 28 in a sealed manner, such that, in the closed state of the centrifuge rotor, no fluid can escape at this point from an interior space 30 formed between the cover 14 and the lower part 12.

In order to catch any fluid that may arise (not shown), a channel 32 is arranged in the lower part 12, specifically below and radially further out with respect to an axis of rotation R of the centrifuge rotor 10 than the seal 34 between the lower part 12 and the cover 14. As a result, such fluid is always diverted away from the seal 34 into the channel 32.

Figure 2:
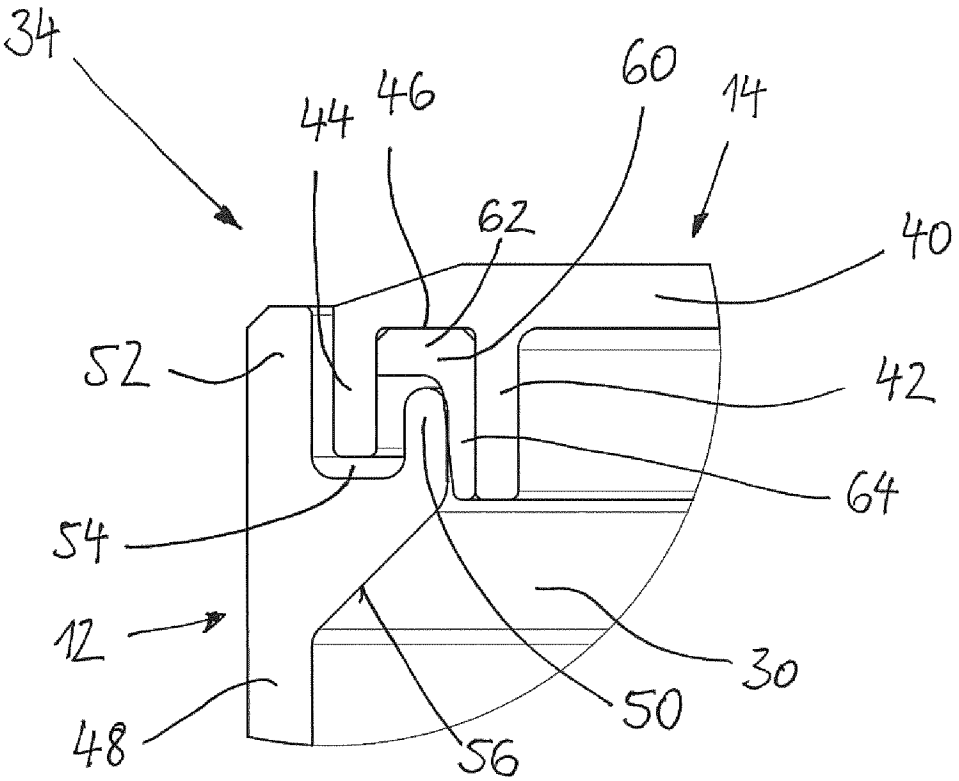
FIG. 2 shows the centrifuge rotor according to FIG. 1 in a detailed view.

FIG. 2 shows the seal 34 in an enlarged detailed view of the area Z from FIG. 1.

It can be seen that the cover 14 has a radially extending wall area 40, from which a first projection 42 and a second projection 44 extend axially downwards towards the lower part 12. The two projections 42, 44 are the lateral boundaries 42, 44 of a first groove 46 opening axially downwards between them towards the lower part 12.

Furthermore, it can be seen that the lower part 12 has a vertically (i.e., axially) extending wall area 48, from which a hook-like projection 50 extends radially inwards into the interior space 30. A second groove 54 is formed by the upper wall section 52 of the wall area 48 and the projection 50, which second groove opens axially upwards towards the cover 14.

It can also be seen that the length of the upper wall section 52 corresponds to the length of the second projection 44 and that the length of the first projection 42 is formed in such a manner that, in the closed state of the cover 14, the hook-like projection 50 is covered by the first projection 42 on the lower part 12.

Below the second groove 54, the hook-like projection 50 is connected to the wall area 48 via a deflector 56 running outwards and downwards in an inclined manner. Any fluid that may accumulate is thus diverted away from the seal 34 into the channel 32. In this connection, the transition from the axial wall area 40 to the first projection 42 could also be formed to be inclined (not shown) in order to improve fluid drainage.

Figure 3:
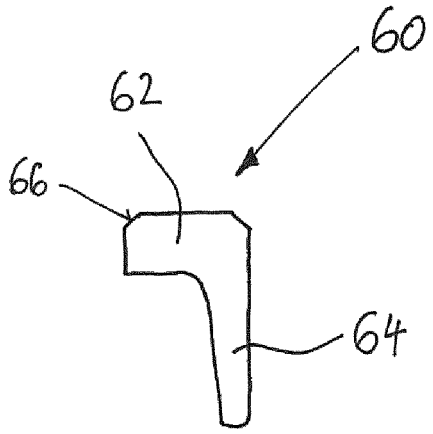
FIG. 3 shows the sealing element used in the centrifuge rotor according to FIG. 1 in a sectional view.

In the first groove 46, the sealing element 60, which consists of a rubber material, is pressed in. It can be seen in particular in connection with FIG. 3 that the sealing element 60 has a radially extending base 62 and an axially extending leg 64 arranged thereon. For uncomplicated pressing into the first groove 46, the sealing element 60 has two chamfers 66 at the base 62.

The thickness of the leg 64 tapers away from the base 62. Thereby, the base has such a thickness that the hook-like projection 50 rests on the base 62 before the second projection 44 rests on the second groove 54.

The tapering of the leg 62 provides a conicity of the sealing element 60, which presses the hook-like projection 50 more strongly against the leg 62 of the sealing element 60, the stronger the cover 14 is pressed against the lower part 12. The conicity lies preferably in the 2°-10° range and particularly amounts to 6°.

In addition, the interlocking first groove 46 and second groove 54 in conjunction with the abutment of the hook-like projection 50 on the leg 62 ensure that a secure centering of the cover 14 on the lower part 12 is effected.

This makes it very easy to place the cover 14 on the lower part 12. In addition, the seal 34 is always and permanently fluid-tight, because, through the conicity of the leg 62, the secure abutment of the hook-like projection 50 on the leg 62 is secured, even with dimensional tolerances.

The fact that the first groove 46 opens axially downwards prevents the gasket 60 from escaping from the first groove 46 due to centrifugation. In addition, centrifugation only increases the sealing effect between the leg 62 and the hook-like projection 50.

There is no warping of the seal even during the closing or opening of the cover 14 on the lower part 12 or during centrifuging, by which there is no risk of damage even when the sealing element 60 is dry.

Finally, the closing process is enormously facilitated by the conicity.

Figure 4:
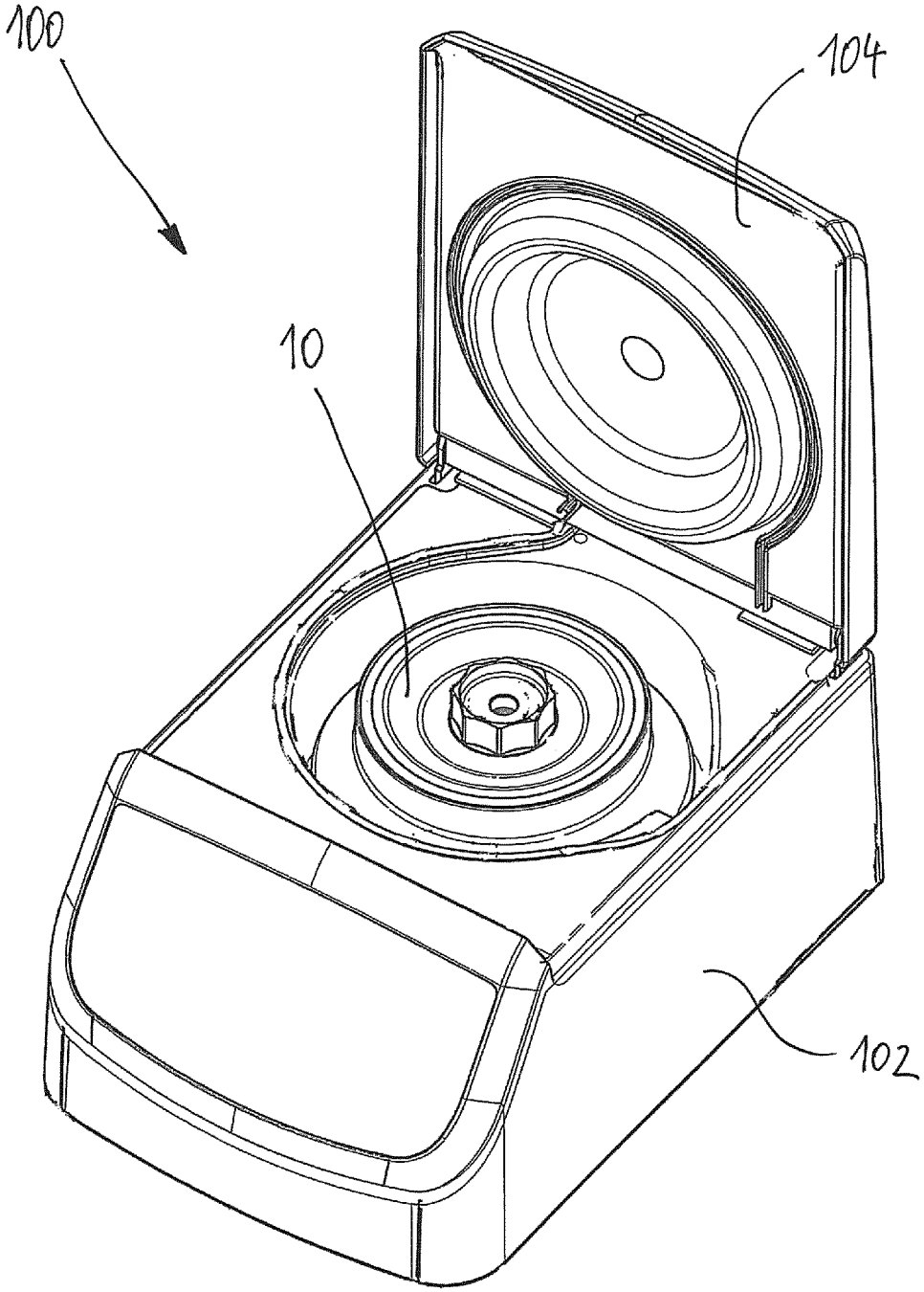
FIG. 4 shows a centrifuge with the centrifuge rotor according to FIG. 1.

FIG. 4 shows the centrifuge 100 with the centrifuge rotor 10. It can be seen that the laboratory centrifuge 100 has, in the usual manner, a housing 102 with a lockable cover 104, wherein, in the interior, corresponding drive means in the form of an electric motor, control means and cooling means are used (not shown).

Figure 5:
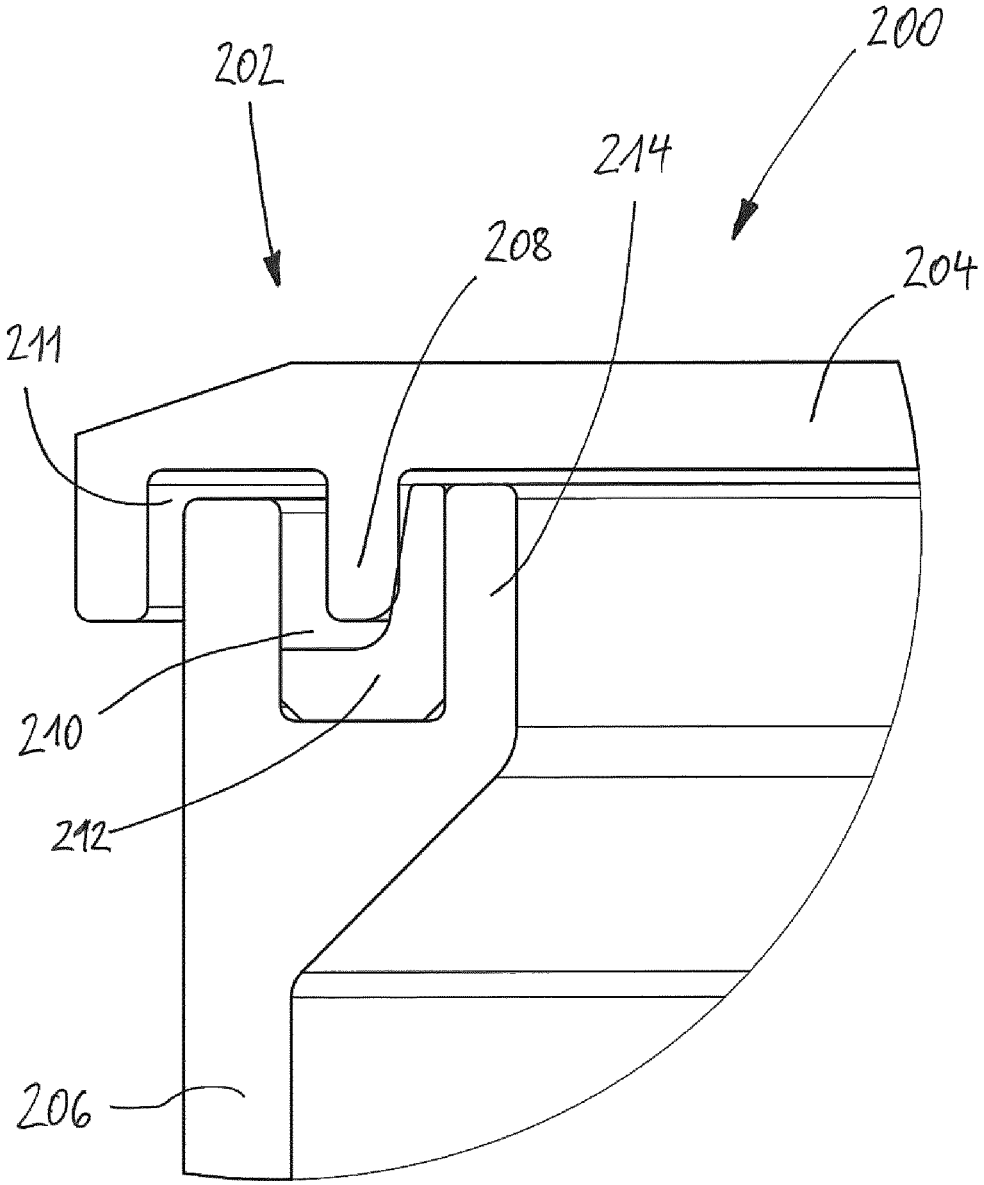
FIG. 5 is a detailed view of a centrifuge rotor in accordance with a second preferred configuration.

FIGS. 1 to 4 show a first preferred embodiment of the centrifuge rotor 10, whereas FIG. 5 shows a second preferred embodiment of the centrifuge rotor 200, wherein only the detailed view of the seal 202 is specifically shown here. All other elements essentially conform to the first preferred embodiment of the centrifuge rotor 10 according to FIGS. 1 to 4.

It can be seen that, here, the cover 204 with a slightly larger radius is formed such that the cover 204 clasps the lower part 206, while, in FIG. 2, it can be seen that the lower part 12 clasps the cover 14 there.

More precisely, the first section 208 is arranged here on the cover 204, and such first section 208 engages in the first groove 210, which is arranged with gasket 212 on the lower part 206. The first groove 210 here is thus formed to open axially towards the cover 204. In reverse, the second groove 211 is formed on the cover 204 and the first section 208 delimits the second groove 211 radially inwards, while the second groove 211 is delimited outwards by the circumferential collar 213.

Moreover, with this arrangement, the seal 202 is highly secure, but the first preferred arrangement according to FIGS. 1 to 4 is still somewhat more advantageous, since, with the variant according to FIG. 5, the fluid that arises can possibly come to lie on the gasket 212 between the first section 208 and the inner boundary 214 of the first groove 210, such that, after an opening of the cover 204, the first groove 210 with the gasket 212 should be cleaned, which would not be necessary with the first preferred arrangement 10, since fluid arising there cannot arrive into the second groove 54.

In addition, it can be seen that the gasket 212 is formed to be identical to gasket 60 according to FIG. 2, wherein it is arranged to be easy to rotate by 180° with respect to the centrifuge rotor 10.

Figure 6:
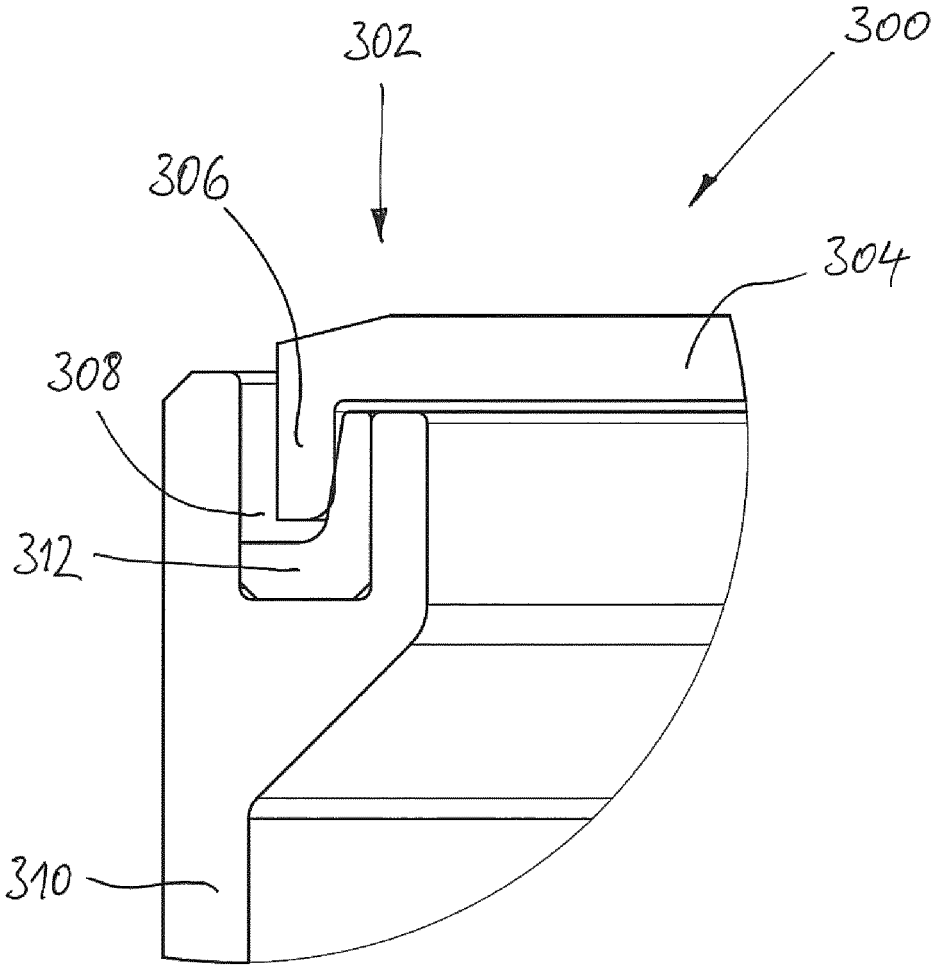
FIG. 6 is a detailed view of the centrifuge rotor in accordance with a third preferred configuration.

FIG. 6 shows a third preferred embodiment of the centrifuge rotor 300, wherein only the detailed view of the seal 302 is specifically shown here. All other elements essentially conform to the first preferred arrangement of the centrifuge rotor 10 according to FIGS. 1 to 4.

The centrifuge rotor according to FIG. 6 only differs from the arrangement according to FIG. 5 in that no external circumferential collar (213 in FIG. 5) is provided; instead, the cover 304 is delimited by the first section 306, which in turn engages in the first groove 308 on the lower part 310 and acts against the gasket 312.

It has become clear from the above illustration that, with the present invention, the seal 34, 202 between the lower part 12, 206 and the cover 14, 204 of the centrifuge rotor 10, 200 has been considerably improved. Thereby, the seal 34, 202 is more effective and more durable than previously used seals. It also facilitates the opening and closing process.

LIST OF REFERENCE SIGNS

10 First preferred arrangement of the centrifuge rotor in accordance with the invention
12 Lower part of the centrifuge rotor 10
14 Cover of the centrifuge rotor 10
16 Bores for receiving sample vessels
18 Shaft support for receiving a drive shaft
20 First locking device on the lower part 12
22 Rotor nut
24 Second locking device of the cover 14
26 Actuating element of the second locking device
28 Cover body
30 Interior space between the lower part 12 and the cover 14
32 Channel in the lower part 12
34 Seal between the lower part 12 and the cover 14
40 Radially extending wall area of the cover 14
42 First projection of the cover 14, first boundary

44 Second projection of the cover 14, second boundary
46 First groove on the cover 14
48 Axially extending wall area of the lower part 12
50 Hook-like projection, first section
52 Upper wall section of the wall area 48
54 Second groove on the lower part 12
56 Deflector
60 Sealing element, gasket
62 Base of the sealing element 60
64 Leg of the sealing element 60
66 Chamfers at the base 62
100 Laboratory centrifuge
102 Housing
104 Cover
200 Second preferred arrangement of the centrifuge rotor in accordance with the invention
202 Seal
204 Cover
206 Lower part
208 First section, inner boundary of the second groove 211
210 First groove
211 Second groove
212 Gasket
213 Circumferential collar
214 Inner boundary of the first groove 210
300 Third preferred arrangement of the centrifuge rotor in accordance with the invention
302 Seal
304 Cover
306 First section
308 First groove
310 Lower part
312 Gasket
R Axis of rotation
Z Detailed section in FIG. 1

The invention claimed is:

1. A centrifuge rotor, comprising
a lower part and
a cover,
wherein sample vessels can be arranged in the centrifuge rotor, the sample vessels being secured against removal in a closed state of the centrifuge rotor,
wherein, in the closed state of the centrifuge rotor, an interior space is formed between the lower part and the cover,
wherein, between the lower part and the cover, there is a seal that seals the interior space in a fluid-tight manner with respect to the surroundings of the centrifuge rotor,
wherein the seal has a gasket that is arranged in a first groove,
wherein the first groove is arranged on one of the elements of cover and lower part,
wherein the first groove is formed to be axially open with respect to an axis of rotation of the centrifuge rotor towards the other of the elements of cover and lower part,
wherein the other of the elements of cover and lower part has a first section extending axially towards the one of the elements of cover and lower part, which in the closed state, extends into the first groove,
wherein the gasket has a radially extending base and an axially extending leg arranged on the radially extending base,
wherein the other of the elements of cover and lower part in the closed state rests on the leg.

2. The centrifuge rotor according to claim 1, wherein the leg becomes thicker towards the base.

3. The centrifuge rotor according to claim 2, wherein the leg is formed to be conical on at least one side having a conicity in the range of 2°-10°.

4. The centrifuge rotor according to claim 2, wherein the leg is formed to be conical on at least one side having a conicity in the range of 4°-8°.

5. The centrifuge rotor according to claim 2, wherein the leg is formed to be conical on at least one side having a conicity of 6°.

6. The centrifuge rotor according to claim 1, wherein the lower part below the gasket has a section that runs radially outwards in a direction away from the cover.

7. The centrifuge rotor according to claim 1, wherein the lower part below the gasket has a section that runs radially outwards in an inclined manner in a direction away from the cover.

8. The centrifuge rotor according to claim 1, wherein the lower part has a channel arranged below and radially outwardly of the gasket.

9. The centrifuge rotor according to claim 1, wherein the other of the elements of cover and lower part has a second groove that opens axially towards the one of the elements of cover and lower part and that interacts with the first groove in the closed state.

10. The centrifuge rotor according to claim 9, wherein the first section radially delimits the second groove to the inside.

11. The centrifuge rotor according to claim 1, wherein the first groove has a radially inner first boundary and a radially outer second boundary.

12. The centrifuge rotor according to claim 11, wherein the first boundary and the second boundary are formed as projections.

13. The centrifuge rotor according to claim 11, wherein the first boundary extends towards the lower part axially deeper than the second boundary.

14. The centrifuge rotor according to claim 11, wherein the first section of the lower part in the closed state is covered by the first boundary.

15. The centrifuge rotor according to claim 1, wherein the centrifuge rotor is a bowl-shaped centrifuge rotor.

16. The centrifuge rotor according to claim 1, wherein the centrifuge rotor is a fixed-angle rotor.

* * * * *